US006447269B1

(12) United States Patent
Rexroth et al.

(10) Patent No.: US 6,447,269 B1
(45) Date of Patent: Sep. 10, 2002

(54) POTABLE WATER PUMP

(75) Inventors: Larry Rexroth, North Hollywood, CA (US); Carlos Medica, Aurora, OR (US)

(73) Assignee: Sota Corporation, North Hollywood, CA (US)

( * ) Notice: Subject to any disclaimer, the term of this patent is extended or adjusted under 35 U.S.C. 154(b) by 0 days.

(21) Appl. No.: 09/738,778

(22) Filed: Dec. 15, 2000

(51) Int. Cl.[7] ..... F04B 17/00

(52) U.S. Cl. ..... 417/365; 417/366; 417/369; 417/370

(58) Field of Search ..... 417/365, 366, 417/369, 370

(56) References Cited

U.S. PATENT DOCUMENTS 2,871,791 A * 2/1959 Litzenberg ..... 417/357
3,583,833 A * 6/1971 Huber ..... 417/360
3,704,078 A * 11/1972 Conery et al. ..... 417/369
3,826,595 A * 7/1974 Bottoms ..... 417/370
4,065,231 A * 12/1977 Litzenberg ..... 417/57
4,234,293 A * 11/1980 Lightle ..... 417/365
4,850,818 A * 7/1989 Kotera ..... 417/366
5,009,578 A * 4/1991 Hyland ..... 417/365
5,209,650 A * 5/1993 Lemieux ..... 417/356
5,248,245 A * 9/1993 Behnke et al. ..... 417/366
5,397,220 A * 3/1995 Akihisa et al. ..... 417/369
5,692,882 A * 12/1997 Bozeman, Jr. et al. ..... 417/45
5,692,886 A * 12/1997 Kobayashi et al. .... 417/423.12

* cited by examiner

*Primary Examiner*—Charles G. Freay
*Assistant Examiner*—John F Belena
(74) *Attorney, Agent, or Firm*—John E. Wagner; Robert C. Smith

(57) ABSTRACT

A water-cooled pump motor for delivering potable water in a demand system includes a centrifugal pump including a volute and an impeller in the volute, an electric motor driving the impeller having a hollow rotor shaft, a rotor on the shaft, bearings supporting the rotor shaft, a stator coaxially outward of the rotor, two water impervious liners, one located within the stator and the other coaxially outside the rotor, the liners being spaced to define a cylindrical passageway across the rotor and a cooling and lubricating water passageway for water to flow through the motor including flow from the impeller between the rotor shaft and the bearings, across the cylindrical passageway and through the hollow rotor shaft back into the volute.

13 Claims, 2 Drawing Sheets

POTABLE WATER PUMP

BACKGROUND OF THE INVENTION

In the field of potable water systems, there is a continuing need for improvement in an electrically driven water pump that can be used for systems of the demand type; that is, a system in which there is a remote store of potable water which may be gravity fed or stored in any source which does not require the water supply to furnish water at a required outlet pressure at a desired flow rate. Such systems are often referred to as demand systems.

The need for improvement is particularly apparent in the case of demand systems for use on aircraft where the supply of water is desired to be maintained at or near ambient pressure in the aircraft rather than under pressure. This substantially reduces the possibility of leaks from a fully pressurized tank of water or from any of its distribution conduits, which deliver pressurized water to any distribution point. Aircraft and their systems are subject to the repeated cycling of ambient pressure which occurs during the normal takeoff, flying at cruising altitude and in landing. Repeated cycling of pressurized structures gives rise to joint failure, particularly where the conduits and joints are at an elevated delivery pressure rather than static ambient pressure.

Demand systems are especially useful for supplying cold and hot potable water where the heater is similarly of the demand type and where there is not a large volume of potable water maintained at delivery pressure and use temperature. The combination of the demand pump and the demand heater with a non-pressurized potable water source present the ideal combination for supplying hot and cold potable water aboard aircraft.

Faced with the foregoing state of the art, we have produced an integrated pump/motor in which potable water flow provides lubrication and cooling of the pump and motor by employing the potable water itself without danger of contamination of the water delivered.

We have also sought to produce a compact pump motor combination weighing just a few pounds and having a system capable of delivering on demand a flow of potable water at flow rates as high as 4 to 6 gpm.

We further sought to design an integrated pump motor in a way in which any ferrous metallic laminations are cooled by the flow of potable water without the danger of corrosive rusting of the laminations.

A further objective is effective cooling of the motor windings while maintaining the windings fully insulated from the cooling flow of potable water.

It is a further object of the invention to provide cooling of all bearings and other rotating surfaces in the motor and in the pump by potable water.

A further objective of the invention is to provide a path for cooling water to flow through the pump/motor shaft after lubricating and cooling all bearings, windings, laminations, and the motor shaft, thereby circulating potable water back into the incoming water stream.

A further objective of the invention is to provide for expansion of water when water inside of the pump freezes, thereby preventing damage to the pump from freezing water.

A further objective of the invention is to provide a means to remove electrical power from the pump when the pump is energized while frozen, thus preventing damage due to overheating of the pump.

BRIEF DESCRIPTION OF THE INVENTION

Each of these objects and design objectives are accomplished in the combination of a centrifugal pump with an electrical motor assembly mounted on a main hollow shaft in a sealed housing in which an annular potable water output manifold includes a port for a lubricating water passage between the rotating and static components of the motor within its housing. The annular output manifold communicates with a second manifold area and continuing flow paths between the pump/motor shaft and a cylindrical bearing at the end of the motor assembly adjacent to the pump. The flow paths continue between the cylindrical bearing and an anti-thrust bearing and further extend through a gap between seals protecting the motor stator windings and laminations and the rotor laminations.

The potable water paths for lubrication continue through a second chamber in the motor assembly and between the rear cylindrical bearing and the rotor shaft, returning through the hollow rotor shaft and through a hollow fastener which secures the pump to the motor drive shaft and back into the potable water output manifold. This series of potable water lubricating paths provide lubrication between all rotating parts of the pump and motor and adjacent non-rotating parts, and provides a recycle path for the lubricating portion of potable water flow, which returns to the main potable water delivery path.

An expansion chamber within the sealed housing allows for expansion of water within the pump if the pump is operated under freezing conditions and the water begins freezing.

A thermal switch located in the motor of the pump causes electrical power to be removed from the pump when the motor of the pump becomes over heated, for example by a locked rotor due to ice formation in the water cooling passage.

BRIEF DESCRIPTION OF THE DRAWINGS

The invention may be more clearly understood from the following detailed description by reference to the drawing in which.

DESCRIPTION OF THE PREFERRED EMBODIMENT

Figure 1:
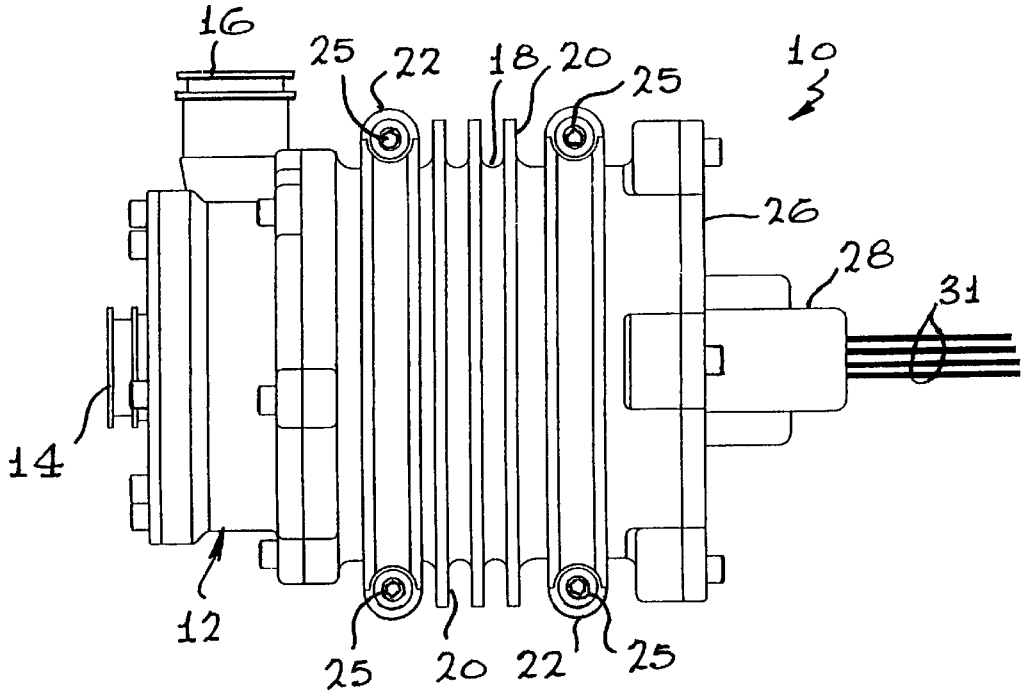
FIG. 1 is a plan view of a combined centrifugal water pump and electrically driven motor in accordance with this invention.
Figure 2:
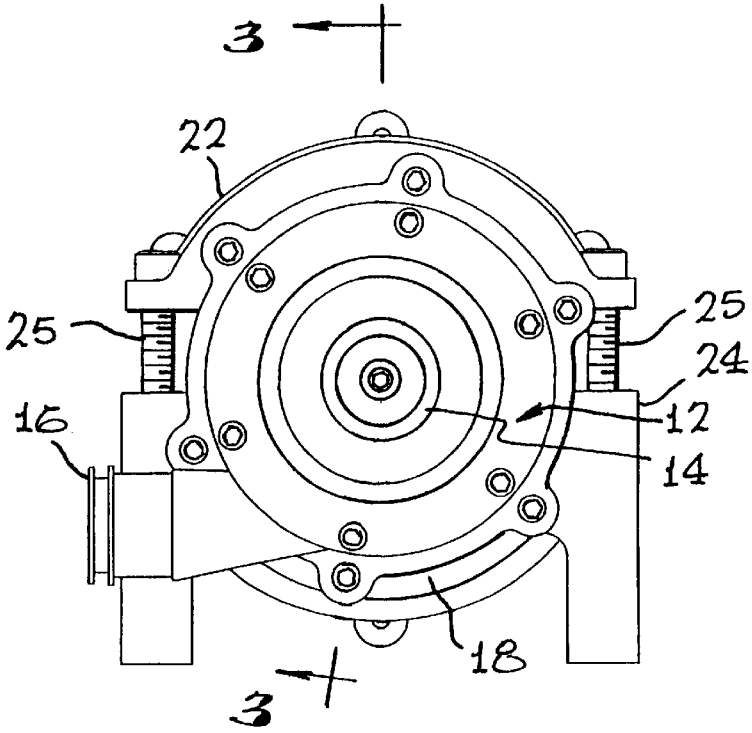
FIG. 2 is a pump end elevational view of the pump/motor combination of FIG. 1.

FIG. 1 is a plan view of a combined centrifugal water pump and electrically driven motor 10 in accordance with this invention. The pump portion includes a volute body 12, including a water inlet member 14. A discharge tube 16 is fastened to volute body 12. Secured to the volute body 12 is a motor housing 18, which incorporates cooling fins 20. Attached to the motor housing 18 are mounting brackets 22 and 24, which include top and bottom portions secured together by bolts 25, which are best seen in FIG. 2. An end cap 26 of FIGS. 1 and 2 closes one end of housing 18 and incorporates a tubular portion 28 carrying a feed through assembly 30 for electrical wires 31 connected to the motor.

Figure 3:
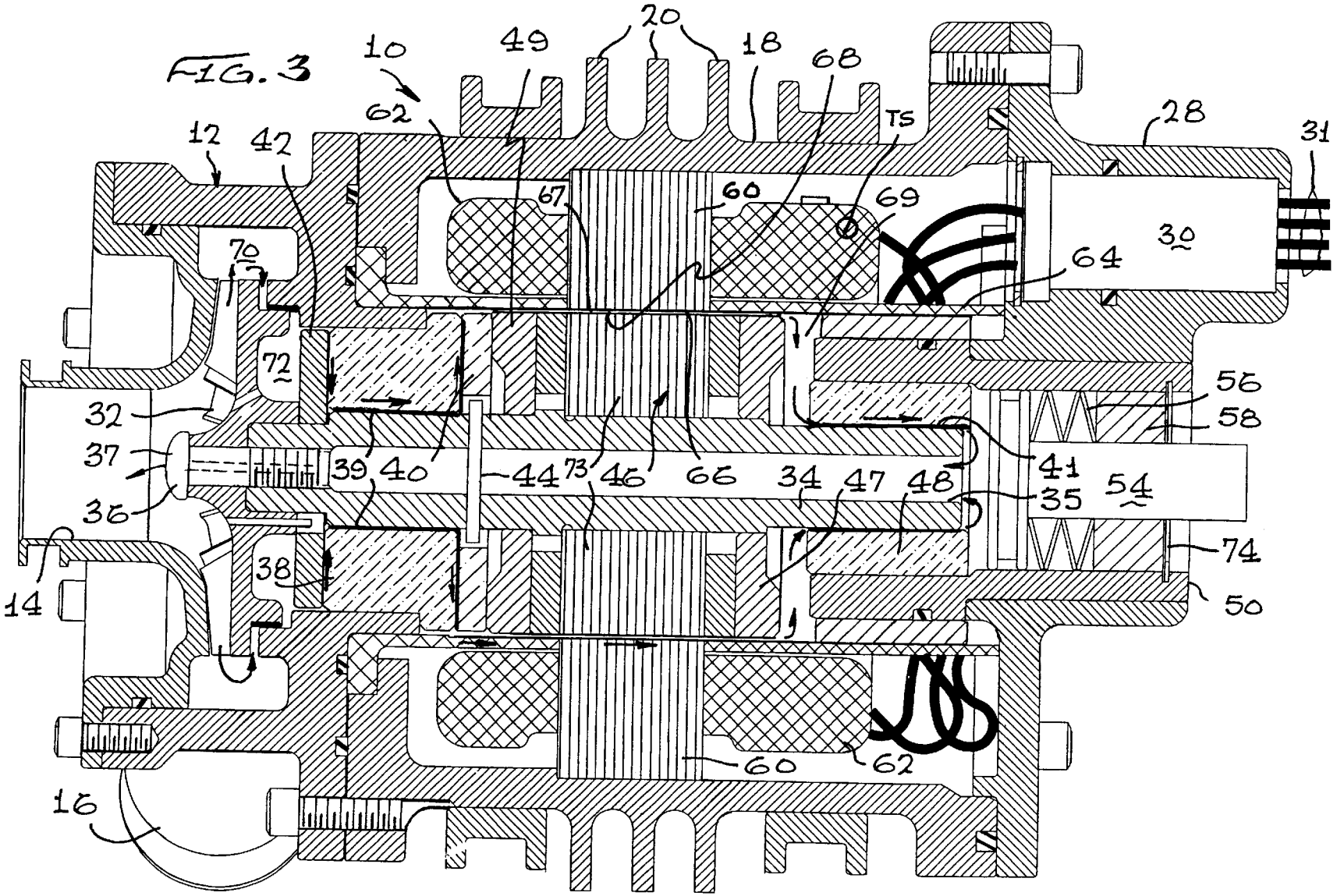
FIG. 3 is an enlarged diametrical sectional view of the pump/motor combination of FIGS. 1 and 2 taken along line 3—3 of FIG. 2.

Details of the combined centrifugal water pump and electrically driven motor 10 will become apparent through consideration of FIG. 3, which is a sectional view taken along line 3—3 of FIG. 2. Carried within the volute 12 is an impeller 32 secured to a hollow rotor shaft 34 by means of a screw 36 having an axial bore 37. At its left end, shaft 34 is supported on a carbon bearing 38 positioned between a thrust plate 40 and a washer 42. A drive pin 44 passes through the shaft 34 and extends into a chamber formed by thrust plate 40, which has an internal diameter slightly larger than the diameter of rotor shaft 34. The function of drive pin 44 is to provide a positive drive for the thrust plate 40.

Carried on the rotor shaft 34 are a plurality of annular steel washers or laminations 73, which, along with rotor end plates 47 and 49, collectively, constitute the rotor 46 of the electric motor. Supporting the opposite end of the rotor shaft 34 is another carbon bearing 48, which is carried in a cylindrical sleeve 50. Movable within a smaller diameter bore of sleeve 50 is a piston 54 which is urged toward the left by a plurality of wave leaf compression springs 56 contained within sleeve 50 by means of a spacer 58 and a retaining ring 74. The piston moving in its bore provides an expansion chamber in case the water within the motor freezes. This avoids any freezing damage to the motor or pump.

Surrounding rotor 46 and secured within housing 18 are a plurality of annular laminations 60 forming part of the stator of the electric motor. Stator windings 62 are wound around both sides of the laminations and are connected to the electrical conductor feed through assembly 30. Positioned in the housing 18 between the stator windings 62 and the rotor 46 is an insulated backing sleeve 64. The stator laminations 60, windings 62 and rotor 46 laminations are separated by thin, stainless steel sleeves 66 and 68, which leave a generally tubular passageway between their adjacent surfaces, namely, the outer surface of 68 and inner surface of 66.

One pair of leads from the feed-through assembly terminates at a thermally operated switch TS, which is bonded to the stator windings 62 to open power to the motor 10 if the stator winding increases in temperature above normal as in the case of a freezing which locks the rotor, after e.g. two minutes, static operation. A suitable thermal switch is a model 4 BTL-2 bimetallic switch of Texas Instruments of Attelboro, Mass.

In operation, with the inlet member 14 connected to a source of potable water under a relatively low pressure, such as a gravity flow from only a few feet of head, energizing of the motor will turn rotor 46, rotating rotor shaft 34 and impeller 32 drawing water into the volute body 12. The greatest part of this water enters volute chamber 70 and is then discharged from discharge tube 16.

Volute chamber 70 has water at the pump discharge pressure, which is somewhat higher than the inlet pressure to the impeller and some of this higher pressure water flows into a chamber 72 between the impeller 32 and the washer 42. Because of clearance between washer 42 and the volute housing 12, water will flow between washer 42 and carbon bearing 38, between carbon bearing 38 and the outer surface of rotor shaft 34, between carbon bearing 38 and thrust plate 40, and between the sleeves 66 and 68. Water flowing from between sleeves 66 and 68 then enters a chamber 69 between rotor endplate 47 and carbon bearing 48, passes between carbon bearing 48 and the outer surface of rotor shaft 34, flows around the right end of rotor shaft 34, through the center passageway 35 of rotor shaft 34, through bore 37 in screw 36, and back into the inlet to the impeller 32. This flow path provides both cooling and lubrication between the rotating and stationary parts of the electric motor and affords little or no occasion to cause contamination of the potable water flowing through the motor. The steel motor laminations 60 are protected from contact with the water running between sleeves 66 and 68, which do allow heat to flow from the laminations into the water.

The above-described embodiments of the present invention are merely descriptive of its principles and are not to be considered limiting. The scope of the present invention instead shall be determined from the scope of the following claims including their equivalents.

We claim:

1. In a pump-motor for delivering potable water in a demand system comprising:

a housing;

a volute body secured to said housing including an inlet port and a discharge tube;

an impeller in said volute body and a first chamber adjacent said impeller;

an electric motor in said housing including a stator, a hollow rotor shaft, a rotor secured to said hollow rotor shaft, and first and second bearings supporting said hollow rotor shaft;

a sleeve in said housing supporting said second bearing, a piston in said sleeve and resilient means urging said piston toward said second bearing, a water-impervious substantially non-magnetic sleeve positioned coaxially within said stator;

a water-impervious substantially non-magnetic sleeve positioned on the outside of said rotor;

said rotor, said sleeves defining a cylindrical path across said rotor; and a lubrication and cooling circuit through said pump-motor including fluid pathways between said hollow rotor shaft and said bearings, through said cylindrical path and through the interior of said hollow rotor shaft to said volute body.

2. A pump-motor as claimed in claim 1 further comprising a thrust plate surrounding said hollow rotor shaft adjacent one of said bearings.

3. A pump-motor as claimed in claim 2 wherein said lubrication and cooling circuit includes a pathway from said volute to said one bearing, between said bearing and said rotor shaft, between said thrust plate and said bearing and connecting with said cylindrical path.

4. A pump-motor as claimed in claim 1 wherein said rotor is secured to said hollow rotor shaft by means of a hollow fastener communicating with said hollow rotor shaft.

5. A water-cooled electrically driven centrifugal pump including a housing, a fluid inlet passage, a volute connected to said fluid inlet passage, an impeller for driving water from said fluid inlet passage into said volute, and a discharge tube connected to said volute;

a rotor shaft in said housing connected to said impeller, an axial bore through said rotor shaft, and a rotor secured to said rotor shaft, first and second bearings supporting said rotor shaft in said housing;

a stator in said housing;

a water-impervious, non-magnetic cylindrical first sleeve positioned on the outside of said rotor;

a water-impervious, non-magnetic cylindrical second sleeve positioned coaxially within said stator;

said cylindrical sleeves defining a generally cylindrical flow path across said rotor between said rotor and stator;

a flow path from said volute and between one of said bearings and said rotor shaft communicating with said generally cylindrical flow path;

a flow path from said generally cylindrical flow path and between the other of said bearings and said rotor shaft; and an additional flow path through the axial bore of said rotor shaft and said hollow fastener to said volute; and an expansion chamber in said housing including a third sleeve supporting one of said bearings, a piston in said sleeve, and a resilient member urging said piston toward said one bearing.

6. A pump-motor as claimed in claim 5 wherein said rotor is secured to said rotor shaft by means of a hollow fastener communicating with the hollow interior of said rotor shaft.

7. A pump-motor as claimed in claim 5 further comprising a thrust plate surrounding said rotor shaft adjacent one of said bearings.

8. A pump-motor as claimed in claim 5 wherein said cylindrical sleeves are substantially non-magnetic.

9. A pump-motor for delivering potable water in a demand system comprising:

a housing;

a volute body secured to said housing including an inlet port and a discharge tube;

an impeller in said volute body and a first chamber adjacent said impeller;

an electric motor in said housing including a stator, a hollow rotor shaft and a rotor secured to said rotor shaft, first and second bearings supporting the end of said hollow rotor shaft nearest said impeller and the end remote from said impeller, respectively;

a thrust plate positioned between said rotor and said first bearing;

a sleeve in said housing carrying said second bearing, a piston movable in said sleeve and a resilient member urging said piston toward said second bearing;

a generally cylindrical water-impervious, non-magnetic liner internal of said stator and a second cylindrical water-impervious, non-magnetic liner external of said rotor, said cylindrical liners defining a generally cylindrical pathway across said rotor;

a second chamber between said rotor and said second bearing; and a lubrication and cooling circuit through said pump-motor comprising said first chamber in said volute body receiving part of the water pumped by said impeller, a water path from said first chamber around a plurality of surfaces of said first bearing, through said generally cylindrical pathway to said second chamber, from said second chamber between said second bearing and said hollow rotor shaft, through the interior of said hollow rotor shaft and into said volute body.

10. A water-cooled electric motor having a stator, a rotor shaft, and a rotor mounted on said rotor shaft, bearings supporting said rotor shaft and cooling, lubricating passageways for circulating water through said motor between said stator and said rotor, said pump-motor incorporating an expansion chamber to prevent damage to the pump-motor when water within the pump-motor is frozen;

said pump-motor incorporating an expansion chamber to prevent damage to the pump-motor when water within the pump-motor is frozen.

11. In a pump-motor for delivering potable water in a demand system comprising:

a housing;

a volute body secured to said housing including an inlet port and a discharge tube;

an impeller in said volute body and a first chamber adjacent said impeller;

an electric motor in said housing including a stator, a hollow rotor shaft, a rotor secured to said hollow rotor shaft, and first and second bearings supporting said hollow rotor shaft, water-impervious substantially non-magnetic liners isolating said stator from said rotor, said liners defining a cylindrical path across said rotor; and a lubrication and cooling circuit through said pump-motor including fluid pathways between said hollow rotor shaft and said bearings, through said cylindrical path and through the interior of said hollow rotor shaft to said volute body;

said pump-motor incorporating an expansion chamber to prevent damage to the pump-motor when water within the pump-motor is frozen.

12. A water-cooled electrically driven centrifugal pump including a housing, a fluid inlet passage, a volute connected to said fluid inlet passage, an impeller for driving water from said fluid inlet passage into said volute, and a discharge tube connected to said volute;

a hollow rotor shaft in said housing connected to said impeller, an axial bore through said rotor shaft, and a rotor secured to said rotor shaft, first and second bearings supporting said rotor shaft in said housing;

a stator in said housing;

a water-impervious sleeve positioned on the outside of said rotor;

a water-impervious sleeve positioned coaxially within said stator;

said sleeves defining a generally cylindrical flow path across said rotor between said rotor and stator;

a flow path from said volute and between one of said bearings and said rotor shaft communicating with said generally cylindrical flow path; and a flow path from said generally cylindrical flow path and between the other of said bearings and said rotor shaft;

an additional flow path through the hollow interior of said rotor shaft to said volute; and said pump-motor incorporating an expansion chamber to prevent damage to the pump-motor when water within the pump-motor is frozen.

13. A pump-motor for delivering potable water in a demand system comprising:

a housing;

a volute body secured to said housing including an inlet port and a discharge tube;

an impeller in said volute body and a first chamber adjacent said impeller;

an electric motor in said housing including a stator, a hollow rotor shaft and a rotor secured to said rotor shaft, first and second bearings supporting the end of said hollow rotor shaft nearest said impeller and the end remote from said impeller, respectively;

a thrust plate positioned between said rotor and said first bearing, and resilient means opposing axial forces on said hollow rotor shaft;

a generally cylindrical water-impervious liner internal of said stator and a second cylindrical water-impervious liner external of said rotor, said liners defining a generally cylindrical pathway across said rotor;

a second chamber between said rotor and said second bearing; and a lubrication and cooling circuit through said pump-motor comprising said first chamber in said volute body receiving part of the water pumped by said impeller, a water path from said first chamber around a plurality of surfaces of said first bearing, through said generally cylindrical pathway to said second chamber, from said second chamber between said second bearing and said rotor shaft, through the hollow interior of said hollow rotor shaft and into said volute body;

said pump-motor incorporating an expansion chamber to prevent damage to the pump-motor when water within the pump-motor is frozen.

* * * * *